United States Patent [19]

Gasse et al.

[11] 4,307,494

[45] Dec. 29, 1981

[54] SAFETY BELT BUCKLE

[76] Inventors: Reinhard Gasse, Ellerndamm 16; Reinhold Hennings, Peterstr. 46, both of D-2200 Elmshorn; Dieter Hermann, Lehmweg 69, D-2081 Holm, all of Fed. Rep. of Germany

[21] Appl. No.: 74,572

[22] Filed: Sep. 11, 1979

[30] Foreign Application Priority Data

Sep. 14, 1978 [DE] Fed. Rep. of Germany ..... 2840076

[51] Int. Cl.[3] ..... A44B 11/25

[52] U.S. Cl. ..... 24/230 AT

[58] Field of Search ..... 24/230 AP, 230 TC, 230 AS, 24/230 AT, 230 A, 230 AK

[56] References Cited

FOREIGN PATENT DOCUMENTS

| | | | |
|---|---|---|---|
| 961628 | 1/1975 | Canada | 24/230 AT |
| 2060789 | 6/1972 | Fed. Rep. of Germany | 24/230 AT |
| 260448 | 9/1928 | Italy | 24/230 AT |

*Primary Examiner*—Roy D. Frazier
*Assistant Examiner*—Alexander Grosz
*Attorney, Agent, or Firm*—Beveridge, DeGrandi, Kline & Lunsford

[57] ABSTRACT

Safety belt buckle comprising a locking part arranged in a buckle housing and a clasp which can be inserted and latched into the locking part and which can be unlocked by means of an operating mechanism, wherein there is a clasp comprising a plate-like blank with engagement recesses constructed in the vicinity of its lateral edges and with a circular guide surface in the front buckle end area and a locking part comprising two single-armed levers arranged in scissor-like manner about a common pivot point in the buckle housing and which are under the action of a locking or tension spring, said levers having at their free ends locking elements which engage in the engagement recesses of the clasp, said locking elements being in operative connection with an operating slide guided on the buckle housing and opening the levers in scissors-like manner for disengaging the clasp.

2 Claims, 4 Drawing Figures

SAFETY BELT BUCKLE

BACKGROUND OF THE INVENTION

The invention relates to a safety belt buckle comprising a locking part arranged in a buckle housing and a clasp which can be inserted and latched into the locking part and which can be unlocked by means of an operating mechanism.

Very varied safety belt buckle constructions are known. Thus, a known safety belt buckle comprises a locking part arranged in a buckle housing and a clasp which can be inserted into the locking part and which can be latched into the latter by means of a locking latch movable at right angles to the direction of movement of the clasp in perpendicular guides on the insides of two lateral guide walls of a mouthpiece arranged on the locking part and comprising a U-shaped section. The latch is under the action of a spring which attempts to force it into the locking position and which can be unlocked by an operating mechanism.

In these known safety belt buckles the clasp is unlocked by means of a pushbutton arranged in the vicinity of a rectangular window opening of the buckle housing receiving the locking part or which comprises an operating slide displaceably held in the mouthpiece of the locking part in the vicinity of a front and top recess of the buckle housing, whereby it is displaceable parallel to the longitudinal direction of the locking part, whilst having on its side facing the locking part and in its front area two lateral guide arms provided with sliding and abutting surfaces inclined in the direction towards the rear area of the operating button and whose ends engage under a rocker pivotably mounted in the rear area of the mouthpiece and arranged on the locking part and which carries on its front underside an unlocking cam insertable perpendicularly into the clasp insertion opening and having a slot-like opening running at right angles to the longitudinal direction of the locking part and in the vicinity of the two guide cams of the mouthpiece for receiving the latch portion of the locking latch, which together with the rocker can be held in the locking position by means of the latch spring.

In the case of safety belt buckles constructed in this way there are numerous components which are in operative connection with one another and which are subject to high levels of wear due to the sliding, interengaging movements. In addition, such mechanically cooperating parts of the locking member of such safety belt buckles make it more difficult to operate the buckle.

BRIEF SUMMARY OF THE INVENTION

The problem of the present invention is to provide a safety belt buckle in which the clasp can be engaged and disengaged with respect to the buckle housing by means of mechanical parts which are subject to rolling and not sliding movements.

According to the invention this problem is solved by a safety belt lock, wherein there is a clasp comprising a plate-like blank with engagement recesses constructed in the vicinity of its lateral edges and with a circular guide surface in the front buckle end area and a locking part comprising two single-armed levers arranged in scissor-like manner about a common pivot point in the buckle housing and which are under the action of a locking or tension spring, said levers having at their free ends locking elements which engage in the engagement recesses of the clasp, said locking elements being in operative connection with an operating slide guided on the buckle housing and opening the levers in scissors-like manner for disengaging the clasp.

According to a preferred embodiment of the invention the safety belt buckle in constructed in such a way in the area of its two lateral edges the clasp has engagement recesses and each of said recesses is bounded by a front portion perpendicular to the longitudinal direction of the buckle, a following portion approximately parallel to the longitudinal direction of the buckle and extending towards the rear buckle end and a following portion which rises towards the rear buckle end, whilst each of the two scissor-like acting levers has at its free end a locking element constructed in linkage-like manner pivotable about a vertical shaft and whose end in the vicinity of the lever end has a cam-like section which can be inserted into the engagement recess of the clasp, whilst the other end of the locking element carries a vertical pivot pin and is connected with the operating slide in such a way that on moving the slide in the longitudinal direction of the buckle the ends of the pivot pins of the locking elements articulated to or engaging on the slide perform a parallel movement, whilst the other ends thereof in the case of a simultaneous opening of the two ends of the levers can be disengaged from the engagement recesses of the clasp.

According to another embodiment of the invention the safety belt buckle is constructed in such a way that in the vicinity of its two lateral edges the clasp has engagement recesses and each recess is bounded by a front portion perpendicular to the longitudinal direction of the clasp, a following portion which is approximately parallel to the longitudinal direction of the clasp and extends towards the rear buckle end and a following portion which rises towards the rear buckle end, whilst each of the two scissors-like acting levers has at its end a shaped-on locking element has a part which can be applied to the portion of the engagement recess of the clasp which is perpendicular to the longitudinal direction of the clasp and with an approximately circular front part following onto the first part, as well as a vertical pin, whereby the pin on the locking element is connected to the pin of the other locking element by means of a tension spring or the like guided in the inner area of the operating slide and which for each pin has a wedge-shaped abutting surface which, on operating the slide, transfers the pin into an obliquely outwardly directed movement path, accompanied by the simultaneous opening of the lever ends.

As a result of the lateral pivoting in and out of the locking elements on the scissors-like opening and closing levers of the locking part on operating the operating slide the clasp is engaged and disengaged by rolling the locking elements out of the lateral engagement recesses of the clasp, so that there are only limited frictional forces, which greatly facilitates the opening of the buckle. As the locking elements engaging in the engagement recesses of the clasp have cam-like profiles it is possible for the locking elements to perform rolling movements with their rolling surfaces on opening and closing the two levers of the locking member, so that sliding movements are avoided, so that the frictional forces which occur are very small.

BRIEF DESCRIPTION OF THE DRAWINGS

The invention is described in greater detail hereinafter relative to non-limitative embodiments of the invention and the attached drawings, wherein show.

DETAILED DESCRIPTION OF THE PREFERRED EMBODIMENTS

Figure 1:
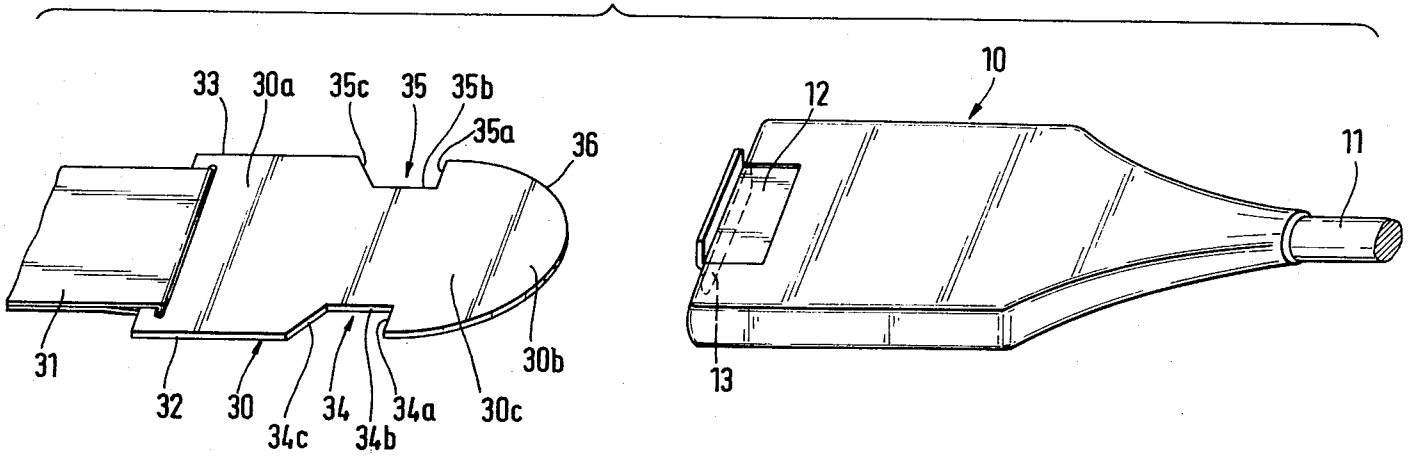
FIG. 1 a safety belt buckle in a diagrammatic view.

The safety belt buckle according to FIG. 1 comprises a sleeve-like buckle housing 10, which receives a holding device not shown in the drawing or a fastening and tie rod 11 connected thereto and a locking member 20 (see FIG. 2) and which is provided with an operating slide 12. At the front the buckle housing 10 has an insertion opening 13 for a clasp 30 insertable into the locking part 20 and to which is connected the strap 31 of the safety belt system. The holding device for the fastening belt and tie rod 11, formed by a relatively rigid wire rope, comprises a flat holding plate with a fixing opening for a fixing bolt and a compressible tubular member as the fixing device for the fastening and tie rod 11. However, other fixing possibilities can also be used. The operating slide 12 is guided in a recess of the buckle housing 10 in such a way that the slide is displaceable in the longitudinal direction of the buckle housing. The operating slide 12 carries the word "press". The operating slide 12 comprises an angular section, whose one member is located above the insertion opening 13 of buckle housing 10, so that the operation of the slide 12 takes place by the action of the thumb or index finger of the hand on the front slide portion located in the vicinity of the clasp insertion opening 13 of locking member 20. Thus, the operating slide can be effortlessly handled and used, even if there is only a limited amount of space between the front seat and the drive shaft tunnel of a vehicle.

Figure 2:
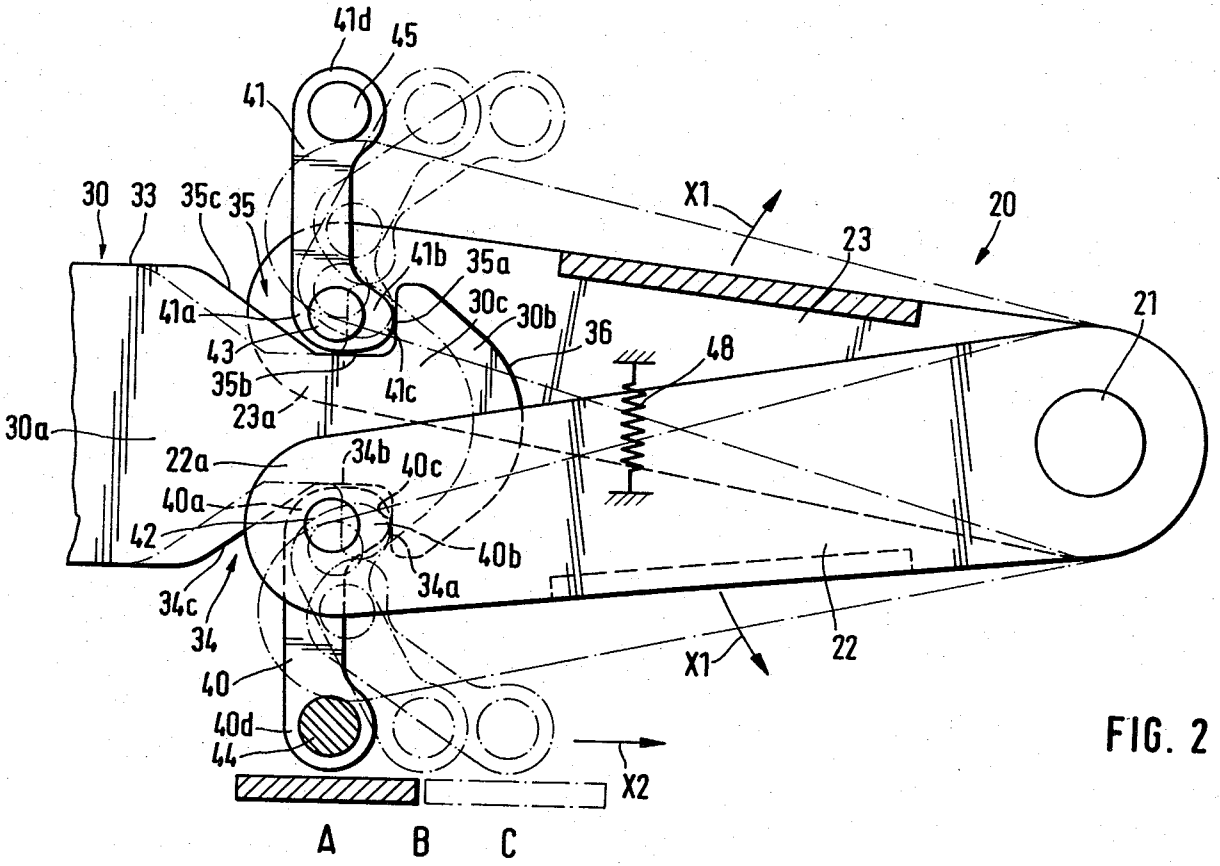
FIG. 2 the locking part engaging in the clasp with various positions of the locking elements engaging in the clasp in a view from above.
Figure 3:
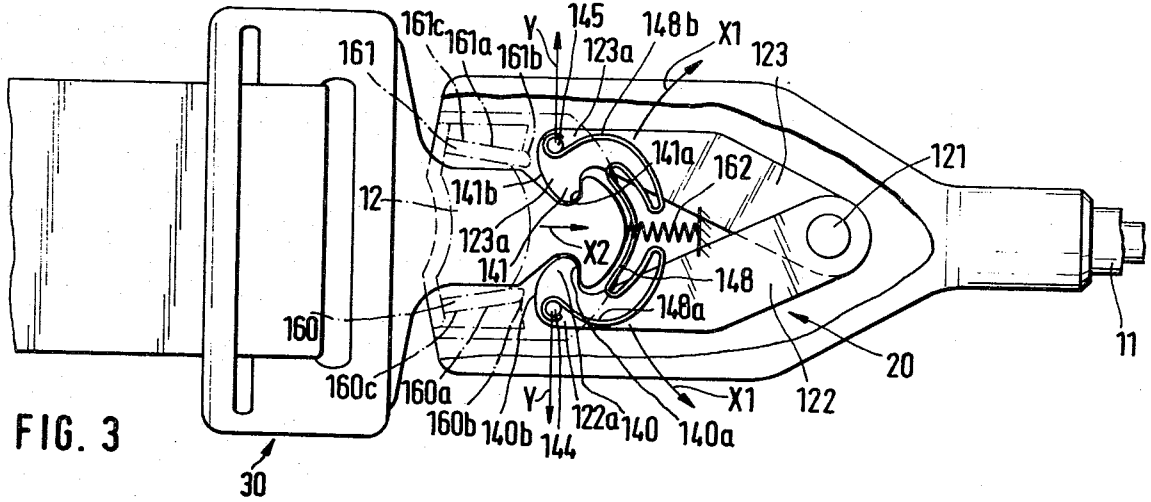
FIG. 3 a further embodiment of the locking part engaging in the clasp in a view from above.

According to FIGS. 2 and 3 the clasp 30 comprises a plate-like blank made from metallic materials. The lateral longitudinal edges of clasp 30 are designated by the reference numerals 32 and 33. In the vicinity of edges 32, 33 is provided in each case an engagement recess 34, 35. Each of the two recesses 34, 35 is bounded by a front portion 34*a* or 35*a* perpendicular to the longitudinal direction of the clasp, a following portion 34*b* or 35*b* approximately parallel to the longitudinal direction of the clasp and extending towards the rear clasp and 30*a*, and a following portion 34*c* or 35*c* which rises towards the rear clamp end 30*a*. The front clasp end 30*b* is constructed in circular manner as a guiding and sliding surface 36, in such a way that the front part of the clasp 30 has a mushroom-shaped construction.

According to the embodiment of FIG. 2 the locking member 20 comprises two single-armed levers 22, 23 which are arranged in the buckle housing 10 about a common pivot point 21 and, which are arranged in such a way that their free ends 22*a*, 23*a* can be opened and closed in scissors-like manner. Each of the free ends 22*a*, 23*a* of levers 22, 23 arranged horizontally in locking member 20 has a locking element 40, 41 articulated to lever ends 22*a*, 23*a*, so that elements 40, 41 can be pivoted about vertical shafts 42, 43. Levers 22, 23 are of the same length.

The ends 40*a*, 41*a* of locking elements 40, 41 located in the articulation area to lever ends 22*a*, 23*a* have the profile 40*b* and 41*b* shown in FIG. 2. Thus, the end areas 40*a*, 41*a* of the linkage-like locking elements 40, 41 are constructed in cam-like manner and have at their end facing the pivot point 21 for the two levers 22, 23 in each case a reinforced portion 40*c*, 41*c*, the ends 40*a*, 41*a* of locking elements 40, 41 being constructed in such a way that on locking clasp 30 in locking part 20 elements 40, 41 with their ends 40*a*, 41*a* come to rest in engagement recesses 34, 35 of clasp 30 in such a way that portions 40*c*, 41*c* of locking elements 40, 41 are engaged on the portions 34*a*, 35*a* of engagement recesses 34, 35 which are perpendicular to the longitudinal direction of the clasp. In this connection there is also a possibility of giving the engagement recesses 34, 35 of clasp 30 a profile which corresponds approximately to the profile of portions 40*a*, 41*a* of the two locking elements 40, 41. However, it is important that ends 40*a*, 41*a* of locking elements 40, 41 and engagement recesses 34, 35 of clasp 30 have portions on which the locking elements 40, 41 can be engaged, so that with closed levers 22, 23 clasp 30 is secured in the position A of slide 12 by the position of locking elements 40, 41.

The other free ends 40*d* and 41*d* of locking elements 40, 41 in each case carry a vertical pivot pin 44 or 45, arranged on the ends 40*d*, 41*d* of locking elements 40, 41 in such a way that part of pins 44, 45 is located above the locking elements 40, 41.

With these free end portions pivot pins 44, 45 engage in correspondingly constructed bearings arranged in the inner area of operating slide 12 or shaped onto the latter, when the slide 12 is made from plastics materials or the like.

The complete arrangement of levers 22, 23 of locking elements 40, 41 with pivot pins 44, 45 and operating slide 12 is such that there is an operative connection between the slide 12, elements 40, 41 and levers 22, 23 in such a way that on operating slide 12, i.e. on moving slide 12 in the longitudinal direction of the clasp pins 44, 45 and therefore ends 40*d*, 41*d* of locking elements 40, 41 perform a movement parallel to the longitudinal direction of the clasp, thereby bringing about the opening of the free ends 22*a*, 23*a* of the two levers 22, 23. Levers 22, 23 are connected by a locking spring or the like 48 arranged in such a way and acting on the two levers in such a way that they are held in the closed position and are only opened when clasp 30 is introduced into locking member 20. During a movement of slide 12 locking elements 40, 41 and/or lever ends 22*a*, 23*a* are forcibly guided.

A safety belt buckle constructed according to FIG. 2 is used in the following manner:

For locking clasp 30 in locking member 20 clasp 30 is introduced into opening 13 of buckle housing 10. Due to the circular configuration of the front portion 30*b* of clasp 30 the free ends 22*a*, 23*a* of the two levers 22, 23 slide laterally past the rolling surface 36 of clasp 30 and simultaneously levers 22, 23 are opened. The insertion of clasp 30 into locking member 20 is only continued until locking elements 40, 41 with their shaped end portions 40*a*, 41*a* come to rest in the engagement recesses 34, 35 of clasp 30, whereby portions 40*c*, 41*c* of ends 40*a*, 41*a* of locking elements 40, 41 engage on portions 34*a*, 35*a* of engagement recesses 34, 35 of clasp 30, so that the latter are arrested in locking member 20 and are secured against pulling out. This locking position is indicated at A in FIG. 2. By means of tension spring 48 the two levers 22, 23 are held in this locking position, so that clasp 30 cannot be automatically released from locking member 20. Tension spring 48 can also be replaced by other means. However, it is important that resilient-elastic elements are used, which on the one hand move lever ends 22*a*, 23*a* towards one another and on the other hand are sufficiently elastic to permit a spreading apart of lever ends 22*a*, 23*a*.

If clasp 30 is now to be disengaged from locking member 20 this is brought about by means of operating slide 12 moved in the clasp insertion direction. Due to the fact that the locking elements 40, 41 with their terminally provided pivot pins 44, 45 are connected with the operating slide valve in the case of a movement of the latter pivot pins are moved in the direction of arrow X2, so that by means of the locking elements 40, 41 the two lever ends 22*a*, 23*a* of levers 22, 23 are spread apart, so that the other ends 40*a*, 41*a* of the two locking elements 40, 41 are disengaged from the engagement recesses 34, 35 of clasp 30. The disengaged position is shown at C in FIG. 2. The intermediate position B shown in this drawing indicates that on moving the operating slide 12 in the direction of arrow X2 the pivot pins 44, 45 with ends 40*a*, 41*a* perform movements which are parallel to the longitudinal direction of the clasp. As a result of this movement sequence from position A to position C via intermediate position B the circular portions 40*c*, 41*c* roll on ends 40*a*, 41*a* of locking elements 40, 41 at portions 34*a*, 35*a* and 34*b*, 35*b* of engagement recesses 34, 35 of clasp 30. FIG. 2 clearly shows the rolling movement of ends 40*a*, 41*a* of the locking elements, so that on reaching the disengaged position C the two levers 22, 23 are pivoted apart in the direction of arrow X1.

Figure 4:
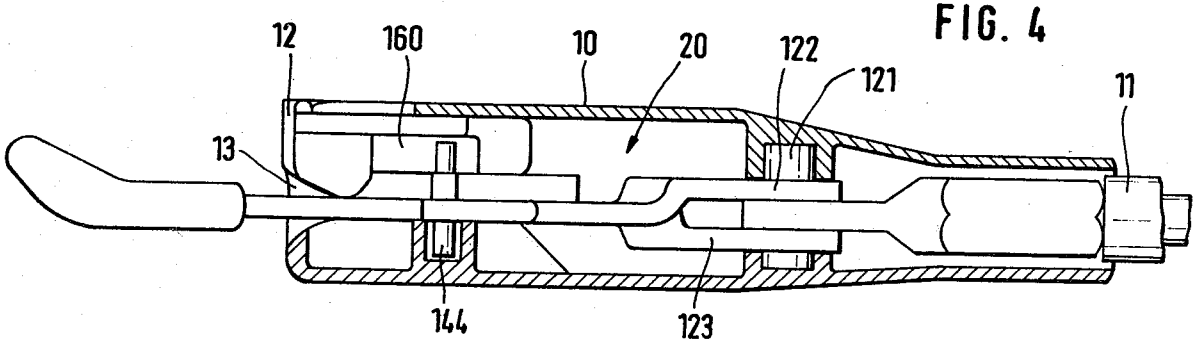
FIG. 4 a vertical longitudinal section through the buckle of FIG. 3.

The further embodiment of a safety belt buckle shown in FIGS. 3 and 4 also comprises buckle housing 10 with the fastening and tie rod 11 and the operating slide 12, as well as the locking member 20 and clasp 30 which can be inserted into the latter. Clasp 30 is constructed in accordance with the embodiment shown in FIG. 2 and described hereinbefore.

Locking member 20 comprises two single-armed levers 122, 123 pivotable about a vertical pivot pin 121 and which can be opened and closed in scissors-like manner. The free lever ends are 122*a*, 123*a*. In place of locking elements 40, 41 articulated to the lever ends of levers 22, 23 the two levers 122, 123 have fixed locking elements 140, 141 shaped onto their ends 122*a*, 123*a*.

Each of the two locking elements 140, 141 has a portion 140*a* or 141*a* at right angles to the longitudinal direction of the clasp 30 in the locking position of the latter and said portion passes into a frontal circular portion 140*b* or 141*b*. Portions 140*a*, 141*a* of the locking elements 140, 141 shaped onto lever ends 122*a*, 123*a* are constructed in such a way that in the locking position, as shown in FIG. 3, elements 140, 141 with their portions 140*a*, 141*a* engage on the vertically directed portions 34*a*, 35*a* of engagement recesses 34, 35 of clasp 30 and in this position lock clasp 30 into locking member 20.

In the area of the shaped-on locking elements 140, 141 each of the ends 122*a*, 123*a* of the two levers 122, 123 has a vertically directed pin 144, 145, which simultaneously serve for fixing the two ends 148*a*, 148*b* of a bow-shaped spring 148. Spring 148 can also be replaced by other resilient-elastic elements and also in other arrangements. The important thing is that these elements force the free ends 122*a*, 123*a* of the two levers 122, 123 towards one another, whereby on inserting clasp 30 into locking member 20 a spreading apart of lever ends 122*a*, 123*a* is possible.

The pins 144, 145 arranged on the ends 122*a*, 123*a* of levers 122, 123 simultaneously serve to control the opening angle of the two levers 122, 123. To this end the two pins 144, 145 are in operative connection with the operating slide 12 of buckle housing 10. In order that the two levers 122, 123 can be spread apart in the direction of arrow X1 when slide 12 is operated in the direction of arrow X2, the slide 12 has abutting surfaces 160, 161 shaped onto the inner area thereof. Abutting surfaces 160, 161 are inclined towards the pivot pin 121 of the two levers 122, 123, so that the external wall portions 160*a*, 161*a* of abutting surfaces 160, 161 serve as sliding and rolling surfaces. Pins 144, 145 on lever ends 122*a*, 123*a* can also be constructed as pivot pins in such a way that they are held in freely movable manner on lever ends 122*a*, 123*a* about vertical axes and as a result when slide 12 moves in the direction of arrow X2 pins 144, 145 can roll on the outer wall surfaces 160*a*, 161*a* of the two abutting surfaces 160, 161. Surfaces 160, 161 are formed by webs vertically shaped onto operating slide 12 and which are made from the same material as the slide. Abutting surfaces 160, 161 are inclined in such a way that on moving slide 12 in the direction of arrow X2 pins 144, 145 initially roll on portions 160*b*, 161*b* of the lateral wall surfaces 160*a*, 161*a* of abutting surfaces 160, 161 and then are guided on the lateral wall surfaces 160*a*, 161*a* to the rear wall surfaces 160*c*, 161*c*, whereby due to the inclined position of surfaces 160, 161 pins 144, 145 are pivoted outwards in the direction of arrow Y and as a result the two levers 122, 123 are opened in such a way that the locking elements 140, 141 are moved out of the engagement recesses 34, 35 of clasp 30, so that the latter is freely located in locking member 20 and can be removed from the latter for unlocking purposes or can be ejected by the spring element 162 in locking member 20.

Clasp 30 is locked in locking member 20 by insertion into said member 20, whereby the two almost closed lever ends 122*a*, 123*a* abut on the circular abutting surface 36 of clasp 30 and laterally slide by the same, so that locking elements 140, 141 come to rest behind the reinforced clasp portion 30*c*. Locking elements 140, 141 can then be pivoted into the engagement recesses 34, 35 and this is brought about by tension springs 148.

The invention is not limited to the embodiments described and represented hereinbefore. Differences in the construction and arrangement of the levers with locking elements 40, 41 or 140, 141 fall within the scope of the invention, as does a different construction of clasp 30 with engagement recesses 34, 35. In addition, the constructional embodiments of the abutting surfaces of levers ends 22*a*, 23*a* or 122*a*, 123*a* as sliding surfaces shown in FIGS. 2, 3 and 4 can be constructed in such a way that the correspondingly shaped front portion 36 of clasp 30 can slide between the two lever ends 22*a*, 23*a* or 122*a*, 123*a* when clasp 30 is introduced into locking member 20.

What is claimed is:

1. A safety belt buckle comprising:

a clasp member formed of a plate-like blank with lateral edges and having engagement recesses in the vicinity of the lateral edges and a circular guide surface in the front end area and joining said engagement recesses, each of said engagement recesses including a portion extending perpendicular to the longitudinal direction of the buckle; and a buckle housing having therein:

(a) a locking part adapted for insertion and latching thereinto of said clasp member and including two single-armed levers each having a first end and a second end; the first end of each of said levers including a locking element having a first end and a cam-like second end adapted to engage the perpendicularly extending portion of one of said engagement recesses of said clasp member;

(b) pivot means pivotally connecting the second end of each of said levers for scissors-like pivotal movement thereof;

(c) spring means pivotally urging said levers toward each other;

(d) A first pivot pin connected to the first end of a first one of said locking elements;

(e) A second pivot pin connected to the first end of the other one of said locking elements;

(f) an operating slide engaging said pivot pins and responsive to longitudinal sliding of said operating slide to pivot said levers away from each other in scissors-like manner against the urging of said spring means for unlatching said clasp member from said locking part.

2. A safety belt buckle comprising:

a clasp member formed of a plate-like blank with lateral edges and having engagement recesses in the vicinity of the lateral edges and a circular guide surface in the front end area and joining said engagement recesses, each of said engagement recesses including a portion extending perpendicular to the longitudinal direction of the buckle; and a buckle housing having therein:

(a) a locking part adapted for insertion and latching thereinto of said clasp member and including two single-armed levers each having a first end and a second end; the first end of each of said levers including a locking element shaped to engage the perpendicularly extending portion of one of said engagement recesses of said clasp member and a pivot pin;

(b) pivot means pivotally connecting the second end of each of said levers for scissors-like pivotal movement thereof;

(c) spring means pivotally urging said levers toward each other; and (d) an operating slide including two surface portions engaging said pivot pins and responsive to longitudinal sliding of said operating slide to pivot said pivot pins and thus said levers away from each other in scissors-like manner against the urging of said spring means for unlatching said clasp member from said locking part.

* * * * *